United States Patent [19]

Elesh

[11] Patent Number: 4,525,409

[45] Date of Patent: Jun. 25, 1985

[54] NYLON OR POLYESTER TREATED FABRIC FOR BEDDING

[75] Inventor: James N. Elesh, Evanston, Ill.

[73] Assignee: Flexi-Mat Corporation, Chicago, Ill.

[21] Appl. No.: 533,293

[22] Filed: Sep. 19, 1983

[51] Int. Cl.[3] ..... B05D 3/02

[52] U.S. Cl. ..... 428/193; 427/2; 427/393.1; 427/393.3; 427/393.4; 427/412; 427/413; 428/257; 428/260; 428/272; 428/337

[58] Field of Search ..... 427/412, 2, 393.3, 393.1, 427/393.4; 5/413, 484; 112/402; 428/192, 193, 257, 260, 272, 337

[56] References Cited

U.S. PATENT DOCUMENTS

| | | | |
|---|---|---|---|
| 2,955,961 | 10/1960 | Koller | 427/393.4 X |
| 3,279,986 | 10/1966 | Hyman | 167/42 |
| 3,598,633 | 8/1971 | Rudman | 427/412 X |
| 3,966,659 | 6/1976 | Oxé et al. | 427/412 |
| 4,265,962 | 5/1981 | May | 427/412 |
| 4,425,395 | 1/1984 | Negishi et al. | 427/412 X |

*Primary Examiner*—Thurman K. Page

*Attorney, Agent, or Firm*—Laff, Whitesel, Conte & Saret

[57] ABSTRACT

A process for making a fabric is used to produce bedding especially well suited for hospitals, nursing homes, jails, mental institutions, and the like. The process begins with a tightly woven taffeta or ripstop weave cloth made from fine nylon or polyester threads. First, one surface of the taffeta is coated with a urethane water repellent. Next, the partially finished product is treated by immersion in a bacteriostatic and fungistatic, a fire retardant, and an anti-static bath. The cloth is then cut and sewn into a desired, at least partially, finished product, such as a pillow cover or mattress ticking and can be vented as desired.

16 Claims, No Drawings

NYLON OR POLYESTER TREATED FABRIC FOR BEDDING

This invention relates to fabrics and to processes for treating fabrics. More particularly, the invention relates to fabrics which are especially—although not exclusively—well suited for use as bedding fabrics (e.g. the covers or ticking for mattresses and pillows) for people confined to bed over extended periods of time, such as patients in hospitals.

Heretofore, this kind of material is usually a loosely woven fabric coated by a waterproof vinyl layer or lamination which is then perforated to make it porous. When the resulting material is used to cover a pillow, it is hot, uncomfortable, and is actually noisy during use.

A person who must remain in bed for long periods of time becomes very sensitive to discomforts caused by these and similar bedding fabrics. For example, under any use, and particularly extended use by a bed-ridden patient, the fabric used to manufacture pillows and mattresses needs to be soft and should not make noise when a person moves. It should be cool to the touch and should not accumulate body heat. In addition, due to government regulations and for safety reasons, the material should be treated with a fire retardant, and with anti-static, anti-bacterial and anti-fungal material. One example of material which has been used heretofore to make pillow and mattress covers is described in U.S. Pat. No. 3,279,986. This material, known under the trademark StaphChek, uses a nylon scrim which is put through a vinyl bath and then ventilated with many tiny holes. This material, however, is still stiff and noisy and retains body heat.

Accordingly, an object of this invention is to provide new and improved fabrics and processes for making fabrics of the above described type. Here, an object is to provide new processes for making more comfortable bedding and especially a more comfortable ticking for pillows and mattresses.

Another object is to provide a new and improved pillow and mattress ticking.

Yet another object of the invention is to provide fabric which does not become offensive as by forming a breeding media for mildew, bacteria, or fungus.

Still another object of the invention is to provide a fire and stain resistant material which breathes by means of air vents and yet does not pass water in a liquid state through the fabric.

Yet a further object of the invention is to provide a fabric which meets all appropriate government regulations.

In keeping with an aspect of the invention, these and other objects are accomplished by providing means for and methods of making a fabric which is tightly woven from very fine strand nylon or polyester (or a combination thereof) filaments which are then coated on one side with a fire-retardant, urethane finish. The resulting product is then treated by being immersed in one or more liquid baths containing fluids providing fire retardant, anti-static, anti-fungal and anti-bacterial characteristics. Then, the material is squeezed dry. After drying, the product is cut and sewn into the desired shape, and air vents are made in the fabric.

In one embodiment, the starting material is a taffeta weave of nylon threads. The threads have a fineness in the range of 70–100 denier, although 70 denier is preferred to provide a softer fabric. The preferred thread density is 88 threads per square inch in one direction and 104 threads per square inch in the other direction.

Alternatively, a ripstop weave can be used. Again, a 70 denier thread is preferred, but the preferred thread density for this weave is 74 threads per square inch in each direction.

To this material, a coating of one ounce of urethane per yard of material is applied to one side of the taffeta. When combined with the tight weave of the nylon strands, the material becomes very water repellent.

The material is then treated with a finish which inhibits the growth of mold, mildew and other bacteria and their associated odors. Since the fabric finish inhibits the growth of bacteria, this treatment also provides a longer resistance to fiber breakdown, thereby increasing the life of the fabric. It also prevents perspiration odors caused by fungal growth. One such anti-mildew and anti-bacteria finish is a commercially available deodorant treatment for fabric which is supplied under the trademark "ULTRA-FRESH", distributed by B. J. Hilton Sales Co., Inc., 200 Madison Ave. New York, N.Y. 10016.

Thomson Research Associate, Ltd. of Toronto, Canada, developer of the ULTRA-FRESH anti-microbial finish, states that the finish can be applied by exhaustion or padding operations, and by spraying or incorporation into adhesive or resin bonding systems. Since the present invention employs a woven fabric, a dipped process in which the fabric is immersed in a fungistat bath is preferred. This finish is durable for laundering and is active over a wide range of microbes, including staphylococcus aureus, a main contributor to odor production.

After or simultaneous to the time the bacteriostatic and fungistatic finish is applied, the material is treated with an antistatic agent. One such agent is the "Zelec DP" brand finish of E. I. duPont de Nemours and Company (Inc.).

According to the duPont company, this finish has the following chemical and physical properties:

| | |
|---|---|
| Composition | Dispersion of complex organic cationic polymers |
| Physical form | Homogeneous, aqueous dispersion |
| Color | Cream |
| Odor | Terpene |
| Viscosity | Moderately viscous |
| pH | 6 to 8 at 10% concentration in water |
| Weight per gallon | 8.5 lb. |
| Ionic charge | Cationic |
| Solubility | Miscible with water in all proportions |
| Solids content | 21% |
| Stability | |
| Normal Storage | Indefinite |
| To Freezing | Can be restored to satisfactory condition by thawing and mixing |

The antistatic agent, like the bacteriostatic and fungistatic finish, can be applied with a padding and drying procedure. The antistatic agent is extended with water at about 120° F. (49° C.) to prepare the pad bath, and application of the agent in the proportion of 2 to 4% of the fabric weight is desirable. The antistatic agent is applied to the fabric using a two or three roll padder and dried in any suitable equipment, preferably at 250° to 280° F. (121° to 138° C.). The fabric should be thoroughly dried, but a curing step is unnecessary.

This finish is durable to repeated washings in a soap solution. The duPont company claims that an effective finish is retained even after 15 to 30 typical home launderings in an automatic washing machine or after 30 to 80 hand launderings. The washing of the fabric in synthetic detergents such as alkylaryl sulfinates greatly reduces the degree of antistatic effectiveness. If a dry cleaning process is used, the remaining effectiveness of the antistatic finish will depend on the solvent and dry cleaning detergent used; synthetic anionic surfactants may have an adverse effect.

The fabric is then treated with a fire retardant finish. One suitable fire retardant is distributed by Auralux Corporation of Norwich, Conn. under the name Pyrolux SNS. This is a durable modified thiourea-based fire retardant designed to produce a soft finish on nylon. While the bacteriostatic, fungistatic, antistatic and fire retardant finishes have been described sequentially, it is usual to simultaneously apply all the finishes in a single immersion bath.

When the material treated in the above described manner was tested, it was found to have unusually superior characteristics. The apparatus and methods used for testing the fire retardance characteristics were those specified in the National Fire Protection Association Standard 702-1975, as set forth in the California Regulations on Flammability Standards for Hospital Fabrics: Title 19, California Administrative Code, Part 2, Sections 1160-1160.16.

The average burning time (in seconds) of five samples of the fabric tested was 13.6, which greatly exceed the 7.0 seconds prescribed by the Code for sheets and pillow cases.

Stain resistance testing was also conducted on the inventive material by using two methods.

First, the fabric was spotted with the below listed staining agents and then immediately wiped with a paper towel to remove any excess staining agent. The fabric was evaluated for the degrees of staining immediately and again after one hour. The second method was to spot the fabric with the same staining agents, which were left undisturbed overnight. The fabric was then washed in a reverse wash wheel according to the AATCC Method 96-80, Test IV E (160° F. wash and tumble dry). After laundering, the fabric was evaluated for the degree of staining as follows:

| | Stain Evaluation | | |
|---|---|---|---|
| | Procedure 1 | | |
| | Immediately | After 1 hr. | Procedure 2 |
| Perspiration | None | None | Slight-None |
| Alcohol | None | None | None |
| Oil (Nujol) | Noticeable | Noticeable | Slight |
| Lubricating Grease | Considerable | Considerable | Considerable |
| Urine | None | None | None |

Liquid penetration resistance testing was done in accordance with the procedures outlined in Federal Test Method Standard 191A-5512, using a Mullen Hydrostatic Unit. According to this test, five samples of the inventive fabric had an average water resistance of 159 p.s.i., which was three times as resistant to liquid penetration as the allowable minimum for household fabrics.

A bloodstain resistance test was also conducted, using the U.S. Testing Company Method. The fabric was soaked in blood for 15 minutes and washed with cold water. The washed fabric had a color alteration between classes 4-5, where class 5 is negligible or no color alteration, class 4 is slight color alteration, class 3 is noticeable color alteration, class 2 is considerable color alteration and class 1 is much color alteration. The class ratings were determined through the use of an AATCC Grey Scale for evaluating color changes.

The antimicrobial properties were tested in accordance with the procedures outlined in AATCC Test Method 90-1974. The samples were placed on agar plates which had been inoculated with Staphylococcus aureus ATCC #6528. Half of the plates were incubated immediately at 35° C., while the other half were refrigerated for twenty-four hours to retard bacterial growth and to allow for diffusion of the antimicrobial. The plates were then incubated for twenty-four hours at 35° C.

| Zones of Inhibition (mm) | |
|---|---|
| non-refrigerated | pre-refrigerated |
| 0/0.5 | 0/0 |

The bacterial reduction assays testing used a 200 mg sample to which a 20 ml phosphate buffer was added and inoculated with $1\times10^5$ bacteria, either Staphylococcus aureus (ATCC #6538) or *Klebsiella pneumoniae* (ATCC #4352). After either one or five hours incubation at 37° C., the bacterial population was enumerated by plate counting, and then was compared to the original population.

| Test Organism | Exposure Time | % Reduction | |
|---|---|---|---|
| | | Blank | Inventive Material |
| *S. aureus* | 1 hr. | 15.13 | 49.34 |
| | 5 hr. | 20.39 | 82.36 |
| *K. pneumoniae* | 1 hr. | 0 | 78.40 |
| | 5 hr. | 32.73 | 97.80 |

The zone of inhibition studies were conducted on a one-square inch swatch of fabric which was placed on a nutrient agar which had been seeded with one of the following three organisms:

*Klebsiella pneumonia* #4352
*Aspergillus niger* #9642
*Aspergillus flavus* #9643

The sample was then incubated at 35° C. for 24–48 hours at which time the zone of inhibition was measured in millimeters.

| Zone of Inhibition (mm) | | |
|---|---|---|
| *K. pneumoniae* | *A. Niger* | *A. flavus* |
| 0 | 2.25 | 0.75 |

A summary of these tests show that the antifungal activity continued to be present. The bacterial reduction studies demonstrated antibacterial activity also continued to be present. However, this activity was less evident in the presence of a high organic load (AATCC 90).

These tests clearly demonstrated the superiority of the inventive process. In addition, products produced from the process are softer, quieter, and cooler during use than previous products.

In order to make pillow ticking, for example, from the inventive material after it has been treated as described previously, the material is cut and sewn into the desired configuration. Four vents are then formed in the corners of the pillow, with two vents in the top and two in the bottom surfaces.

The inventive material can also be used for mattress ticking. Those who are skilled in the art will readily perceive many other uses for the inventive material.

Those who are skilled in the art will also readily perceive how to modify the invention. Therefore, the appended claims are to be construed to cover all equivalent structures which fall within the true scope and spirit of the invention.

I claim:

1. A process for making a fabric comprising the steps of:

(a) tightly weaving a cloth selected from the group consisting of nylon and polyester threads or a combination thereof;

(b) coating one surface with a fire retardant, water repellent urethane; and (c) immersing the cloth in a fluid bath containing a bacteriostatic and fungistatic agent, a fire retardant, and a cationic anitstatic agent, said cationic antistat agent comprising a homogeneous, aqueous dispersion of organic cationic polymers, the solids content being about 21%, the weight of said cationic antistat agent being about 8.5 pounds per gallon, the viscosity of said cationic antistat agent being moderately viscous, and the pH of said cationic antistat agent ranging from about 6.0 to about 8.0 when present in water at a concentration of 10%.

2. The process of claim 1 wherein said threads have a denier of 70.

3. The process of claim 1 wherein said threads have a density of 88 threads per square inch in one direction and 104 threads per square inch in the other direction.

4. The process of claim 1 wherein said urethane coating is applied in the amount of one ounce of urethane per yard of taffeta.

5. The process of claim 1 wherein said cloth is a taffeta weave.

6. The process of claim 1 wherein said cloth is a ripstop weave.

7. The product made by the process of claim 1.

8. A process for making a fabric comprising the steps of:

(a) tightly weaving a cloth from the group consisting of polyester and nylon threads or a combination thereof;

(b) coating one surface of the cloth with a fire retardant, water repellent urethane;

(c) immersing the cloth in a deodorant bacteriostatic and fungistatic fluid bath;

(d) immersing the cloth in a cationic antistatic fluid bath;

(e) immersing the cloth in a flame retardant fluid bath; and (f) drying the cloth.

9. The process of claim 8 including the additional step of cutting and sewing the fabric into a desired shape.

10. The process of claim 9 wherein the cutting and sewing step forms a pillow covering.

11. The process of claim 10 and the added step of forming vents in the pillow covering.

12. The process of claim 11 wherein at least two vents are formed in corners of the upper surface of the pillow and at least two vents are formed in the lower surface of the pillow.

13. The process of claim 8 wherein said cloth is woven into a taffeta weave.

14. The process of claim 8 wherein said cloth is woven into a ripstop weave.

15. A mattress cover made by the process of claim 9.

16. The product made by the process of claim 8.

* * * * *